US006299267B1

(12) United States Patent
Butters

(10) Patent No.: US 6,299,267 B1
(45) Date of Patent: Oct. 9, 2001

(54) CABINET MOUNTED CUTTING BOARD

(76) Inventor: Allen J. Butters, 465 Grant Ave., Ogden, UT (US) 84404

( * ) Notice: Subject to any disclaimer, the term of this patent is extended or adjusted under 35 U.S.C. 154(b) by 0 days.

(21) Appl. No.: 09/657,377

(22) Filed: Sep. 8, 2000

(51) Int. Cl.[7] ..... A47B 67/02
(52) U.S. Cl. ..... 312/246; 108/143
(58) Field of Search ..... 312/246, 233, 312/245, 334.1, 334.23, 349; 108/149, 137, 42, 93, 102, 143; 248/298.1, 295.11

(56) References Cited

U.S. PATENT DOCUMENTS 132,165 * 10/1872 Maples ..... 312/246
1,073,483 * 9/1913 Frost ..... 108/93 X
2,616,775 * 11/1952 Nesbitt et al. ..... 108/143 X
4,184,725 * 1/1980 Spangler ..... 312/246 X
4,632,472 * 12/1986 Bross ..... 312/246
4,736,689 * 4/1988 Stanko ..... 312/246 X
4,944,566 * 7/1990 Carper ..... 312/246 X
5,626,067 * 5/1997 Lothe .
5,662,371 * 9/1997 Gera et al. ..... 312/334.1 X
5,848,772 * 12/1998 Fitzgerald .

* cited by examiner

*Primary Examiner*—Jose V. Chen
(74) *Attorney, Agent, or Firm*—Clayton, Howarth & Cannon, P.C.

(57) ABSTRACT

A cabinet mounted cutting board is disclosed. The device includes a mounting member having a pair of opposing channels for receiving opposite sides of the cutting board. The channels are connected by metal strips having apertures for receiving fasteners. The mounting member is attached to the underside of a cabinet over a countertop for convenient storage and use of the cutting board. The device is easily manufactured and installed without the need for expensive reconstruction of the cabinets.

18 Claims, 3 Drawing Sheets

CABINET MOUNTED CUTTING BOARD

BACKGROUND OF THE INVENTION

1. The Field of the Invention

The present invention relates generally to mounting devices for cutting boards, and more particularly, but not necessarily entirely, to a mounting device for mounting a cutting board on the underside of a wall cabinet, typically located over a countertop.

2. Description of Related Art

Cutting boards are well known accessories in kitchens and industrial settings to provide users with a cutting surface for cutting items without causing damage to underlying surfaces or knives. Cutting boards are constructed of diverse materials in various sizes and shapes. Commonly, cutting boards are portable or are concealed in cabinets. Concealed cutting boards are commonly integral parts of the cabinets, sliding in slots from a stored position to an accessible position. Such concealed cutting boards are convenient but are usually constructed as part of the cabinet. Therefore, retrofitting a cabinet with a concealed cutting board feature requires extensive reconstruction and is usually not feasible.

Attempts have been made in the prior art to provide alternative cutting board storage devices. U.S. Pat. No. 5,848,772 (granted Dec. 15, 1998 to Fitzgerald) discloses a kitchen cutting board storage apparatus which uses a series of brackets for restricting the lateral and linear movement of the cutting board. Adhesive strips are used to attach the brackets to a surface. Thus, if a strong adhesive is used, the storage device cannot be removed without causing damage to the surface. If a weaker adhesive is used, the storage device is not attached with sufficient strength to withstand cutting forces applied to the board while in the storage device. Furthermore, the device requires the cutting board to slide flush with the attaching surface. Therefore, the device is not suited for use on the underside of wall cabinets having a vertical edge extending below the front bottom of the cabinet.

The prior art is thus characterized by several disadvantages that are addressed by the present invention.

The present invention minimizes, and in some aspects eliminates, the above-mentioned failures, and other problems, by utilizing the methods and structural features described herein.

In view of the drawbacks inherent in the available art, it would be a significant advance in the art to provide a mounted cutting board device which is simple in design and manufacture and capable of being installed on existing cabinetry and removed if desired. It would also be an advancement in the art to provide a cabinet mounted cutting board which is easy to install and capable of withstanding significant forces.

BRIEF SUMMARY AND OBJECTS OF THE INVENTION

It is therefore an object of the present invention to provide a cabinet mounted cutting board device which is simple in design and manufacture.

It is another object of the present invention to provide such a cabinet mounted cutting board capable of being installed on existing cabinetry and removed if desired.

It is another object of the present invention to provide such a cabinet mounted cutting board which is easy to install.

It is an additional object of the invention to provide a mounting device for a cutting board capable of withstanding significant forces.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

The present invention accomplishes these objects using a novel structure providing advantages not previously available in the art. The present invention includes a cabinet mounted cutting board for attaching on a surface such as an underside of a wall mounted cabinet over a countertop. The cabinet mounted cutting board includes a cutting board and a mounting member. The mounting member has at least one attaching portion for attaching the mounting member to the underside of the wall mounted cabinet, and a support portion for supporting the cutting board. The support portion has a first support member for supporting a first side of the cutting board and a second support member for supporting a second side of the cutting board. The attaching portion and the support portion are connected to form a single piece.

The attaching portion has apertures for receiving fasteners to fasten the mounting member to the cabinet. The attaching portion also has a planar portion with a first attaching end and an opposing second attaching end, the first and second attaching ends are bent angularly from the planar portion. The first attaching end is attached to the first support member, and the second attaching end is attached to the second support member such that a space is provided between the planar portion and the support portion to form an offset to enable the cutting board to clear a front edge of the cabinet.

In a preferred embodiment, the first and second support members are channel shaped and capped at their ends to limit sliding of the cutting board. However, the first and second support members can be made of a single piece of channel shaped material bent to form a substantial U shape, the connecting member forming a stop to limit the movement of the cutting board.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE PREFERRED EMBODIMENTS

Figure 1:
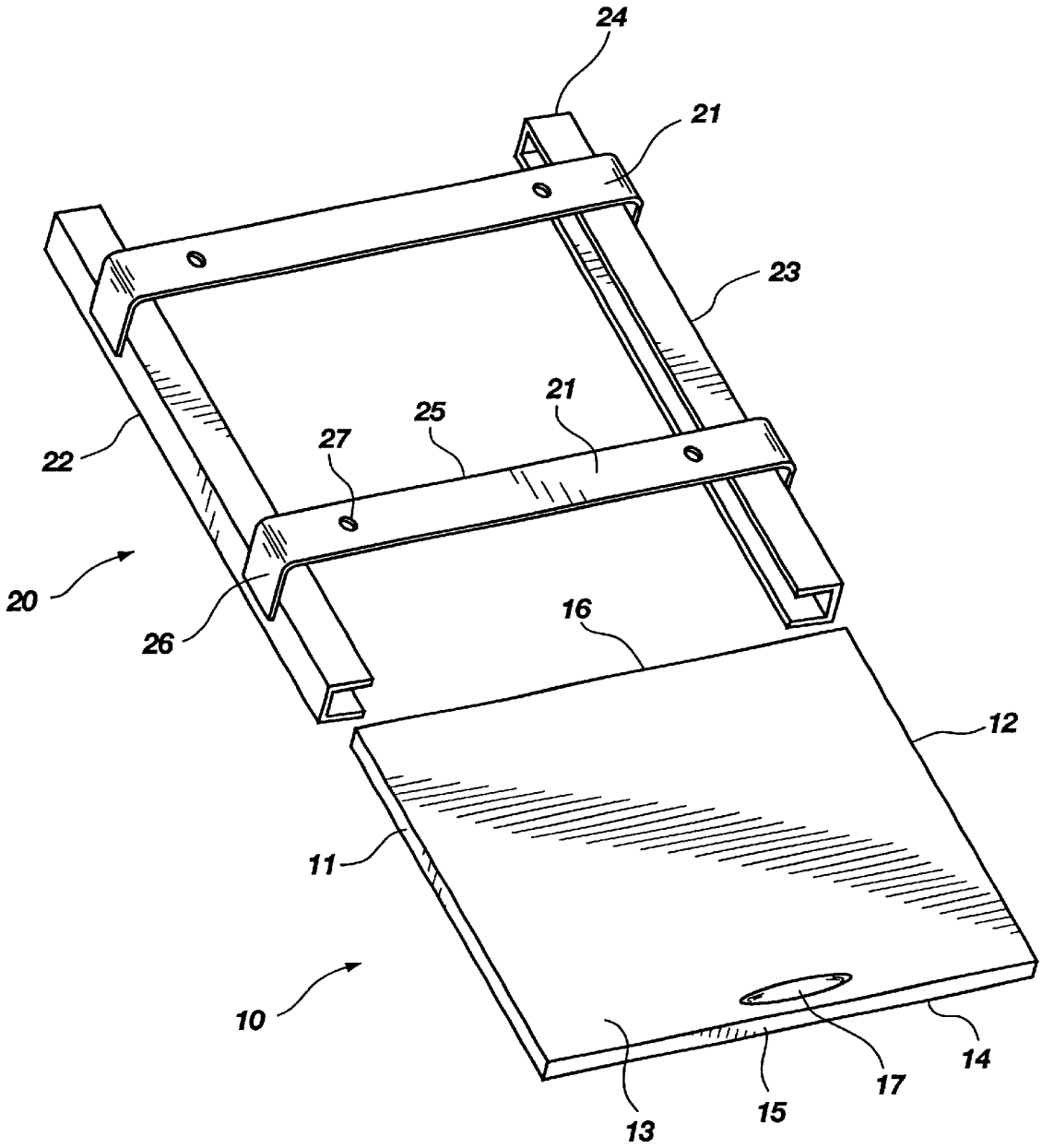
FIG. 1 is a perspective view of a cabinet mounted cutting board in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Referring now to FIG. 1, a preferred embodiment of the cabinet mounted cutting board is shown including a cutting board, generally indicated at 10. The cutting board has a first side 11, a second side 12, a top 13, a bottom 14, and proximal 15 and distal 16 ends. A handle 17 is located toward the cutting board proximal end. The cutting board is made of any suitable material such as wood or plastic and is preferably dimensioned 12 inches by 14 inches, but other dimensions may also be used within the scope of the present invention.

A mounting member, generally indicated at 20 is preferably made of metal but can be constructed of other suitable materials such as wood or plastic. Mounting member 20 has attaching portions 21 and a support portion consisting of a first support member 22 and a second support member 23. The first and second support members are channel shaped for receiving the first and second sides 11, 12 of the cutting board respectively. However, it can be appreciated that the first and second support members can have other shapes such as "L" shapes or flat configurations. Distal ends 24 of the support members are capped to prevent the cutting board from sliding behind the mounting member, generally indicated at 20. This allows the cutting board to maintain an accessible position and prevents the board from contacting items behind the mounting member.

Figure 2:
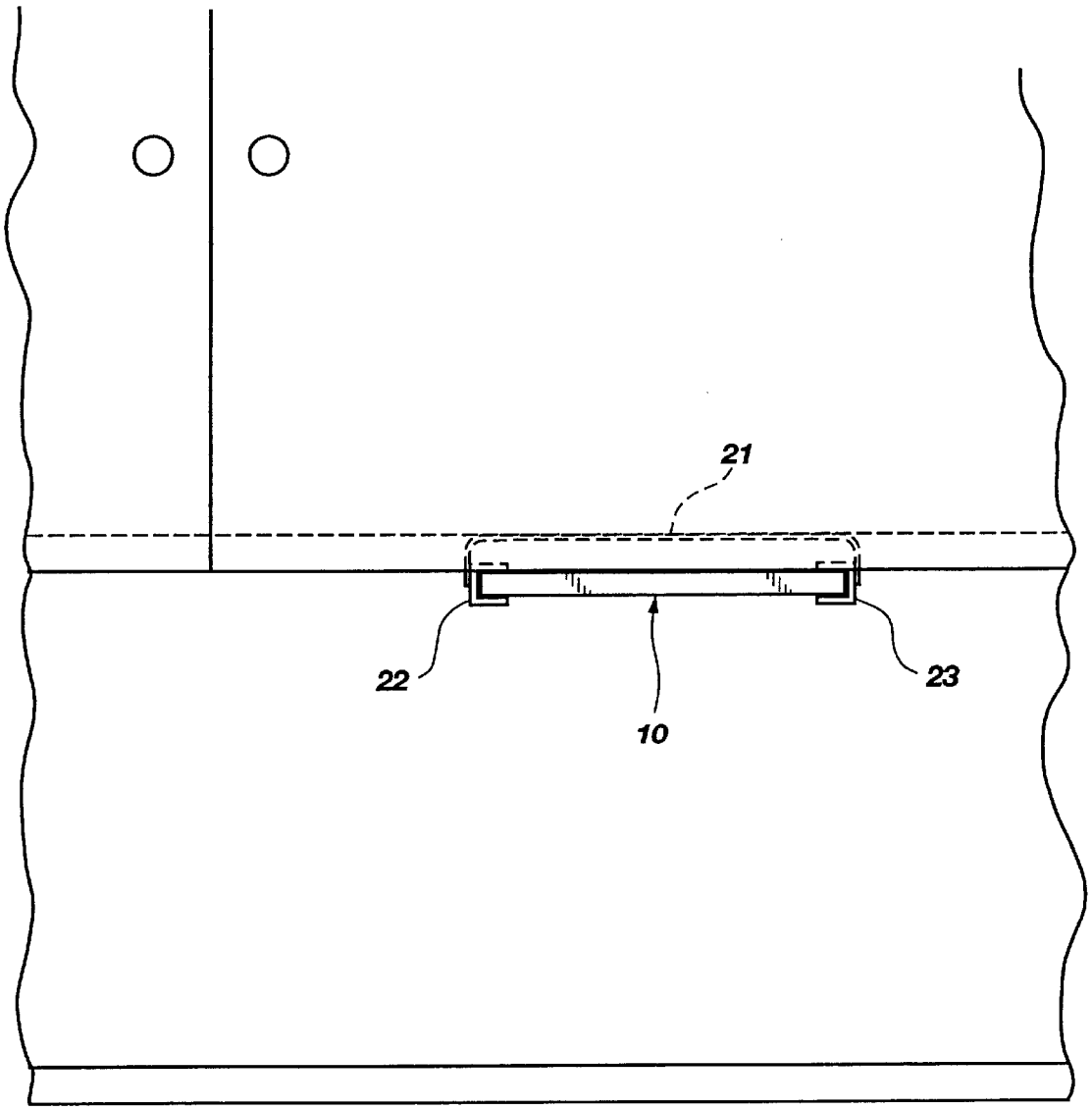
FIG. 2 is a front view a cabinet mounted cutting board attached to the underside of a wall cabinet over a countertop.

Attaching portions 21 are preferably elongate pieces of metal and have planar portions 25 and attaching ends 26 bent angularly from the planar portions. The planar portions have apertures 27 for receiving fasteners such as screws or nails to attach the mounting member to a surface such as the underside of a cabinet as shown in FIG. 2. The attaching portions are attached to the support members 22, 23 by suitable methods such as welding, such that the support members are spaced approximately one inch from the planar portion. This space provides an offset so that the cutting board can clear the front edge of the cabinets which typically extends below the cabinet bottom as shown in FIG. 2.

Installation of the mounting member is easily accomplished since the mounting member is a single piece and alignment of different parts is not necessary. The mounting member is positioned as desired under the wall cabinet, then fasteners are inserted in the apertures 27 to fasten the mounting member to the cabinet. The mounting member is rigidly fixed to the cabinet such that a user may partially slide the cutting board out of the mounting member for use in place. Also the cutting board may be completely removed from the mounting member and placed on another surface for use. If so desired, the mounting member may be removed from the cabinet without causing damage by removing the fasteners.

Figure 3:
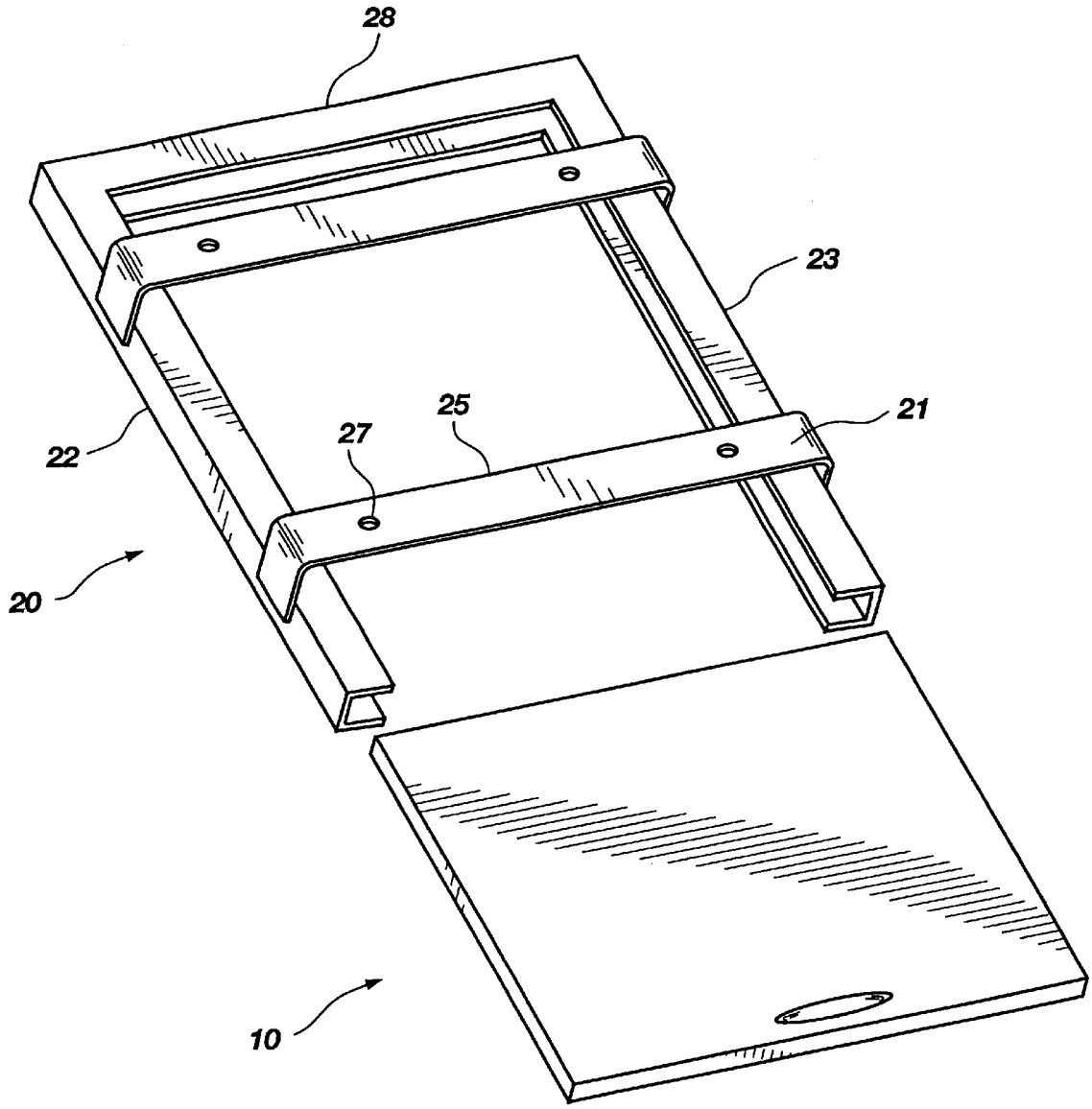
FIG. 3 is a perspective view of an alternative embodiment of the cabinet mounted cutting board of FIG. 1.

An alternative embodiment of the mounting member is shown in FIG. 3. The alternative embodiment is similar to the embodiment shown in FIG. 1 except that the first and second support members 22, 23 are connected at their distal ends by a stop member 28. Stop member 28 has a similar function as the capped ends in FIG. 1, however, the stop member 28 is formed by bending a single piece of material to a substantially U shape. Thus, the alternative embodiment of FIG. 3 is easily constructed.

It will be appreciated that the mounting member may be installed on surfaces other than underneath wall cabinets as discussed above. For example the mounting member may be installed on walls, exterior and interior sides of cabinets, and under counters or work benches.

In view of the foregoing, it will be appreciated that the present invention provides a mounted cutting board device which is simple in design and manufacture and capable of being installed on existing cabinetry and removed if desired. The mounted cutting board is easy to install and capable of withstanding significant forces.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A mounted cutting board for attaching on a surface, said mounted cutting board comprising:

a cutting board having a first side, a second side, a top, a bottom, and proximal and distal ends;

a mounting member comprising at least one attaching portion for attaching the mounting member to the surface, and a support portion for supporting the cutting board;

said support portion comprising a first support member for supporting said first side of said cutting board and a second support member for supporting said second side of said cutting board, said attaching portion and said support portion being connected to form a single piece;

wherein said at least one attaching portion comprises a planar portion with a first attaching end and an opposing second attaching end, said first and second attaching ends being bent angularly from the planar portion, said first attaching end attached to said first support member, and said second attaching end being attached to said second support member such that a space is provided between the planar portion and the support portion.

2. The mounted cutting board of claim 1 wherein said at least one attaching portion comprises at least one aperture for receiving a fastener to fasten the mounting member to the surface.

3. The mounted cutting board of claim 1 wherein the first and second support members are connected by a stop member to form a substantial U shape, said stop member limits the movement of the cutting board when abutted by the distal end of the cutting board.

4. The mounted cutting board of claim 1 wherein said first and second support members are channel shaped to receive the first and second sides of the cutting board.

5. The mounted cutting board of claim 1 wherein said first and second support members are capped at distal ends thereof to limit the movement of the cutting board when the distal end of the cutting board abuts the caps.

6. The mounted cutting board of claim 1 wherein said attaching portion is welded to said support portion.

7. The mounted cutting board of claim 1 wherein the space between the planar portion and the support portion comprises approximately one inch to form an offset for the cutting board to clear a front edge of a cabinet.

8. The mounted cutting board of claim 1 wherein the cutting board comprises a handle at said proximal end.

9. The mounted cutting board of claim 1 wherein said at least one attaching portion for attaching the mounting member to the surface comprises two attaching portions.

10. A mounting member for mounting a cutting board on a surface, said mounting member comprising:

a support portion comprising a first support member and an opposing second support member for slidably receiving opposite sides of the cutting board, an attaching portion comprising at least one attaching member having a planar portion with opposing first and second attaching ends bent angularly from the planar portion, said first attaching end attached to said first support member and said second attaching end attached to said second support member to form said mounting member as one piece, said planar portion having a plurality of apertures for receiving fasteners for fastening the mounting member to the surface.

11. The mounting member of claim 10 wherein the first and second support members are connected by a stop member to prevent the cutting board from sliding beyond a distal end of the mounting member.

12. The mounting member of claim 10 wherein a space is provided between said planar portion and said support portion.

13. The mounting member of claim 12 wherein the space between the planar portion and the support portion comprises approximately one inch to form an offset to enable the cutting board to clear a front edge of a cabinet.

14. The mounting member of claim 10 wherein said first and second support members are channel shaped.

15. The mounting member of claim 10 wherein said first and second support members are capped at distal ends thereof to prevent the cutting board from sliding beyond said distal ends of said first and second support members.

16. The mounting member of claim 10 wherein said attaching portion is welded to said support portion.

17. The mounting member of claim 10 wherein said at least one attaching member comprises two attaching members.

18. A cabinet mounted cutting board for attaching on an underside of a wall mounted cabinet over a countertop, said cabinet mounted cutting board comprising:

a cutting board having a first side, a second side, a top, a bottom, proximal and distal ends, and a handle disposed on said proximal end;

a mounting member comprising an attaching portion for attaching the mounting member to the underside of the wall mounted cabinet, and a support portion for supporting the cutting board;

said support portion comprising a first channel member for supporting said first side of said cutting board and a second channel member for supporting said second side of said cutting board, and a stop disposed on distal ends of said first and second channel members for preventing the cutting board from sliding beyond the distal ends of the first and second channel members, said support portion being connected to said attaching portion to form said mounting member as a single piece;

said attaching portion comprising a pair of elongate members having planar portions with a plurality of apertures for receiving fasteners to fasten the mounting member to the underside of the wall mounted cabinet, said elongate members comprising first attaching ends and opposing second attaching ends, said first and second attaching ends being bent angularly from the planar portions, said first attaching ends being attached to said first channel member and said second attaching ends being attached to said second channel member such that an offset of approximately one inch is provided between the planar portions and the first and second channel members to enable the cutting board to clear a front edge of the wall mounted cabinet.

* * * * *